US006283431B1

(12) United States Patent
Nepper, Sr.

(10) Patent No.: US 6,283,431 B1
(45) Date of Patent: Sep. 4, 2001

(54) THERMOFORMED LOAD-BEARING PLATFORM

(76) Inventor: John P. Nepper, Sr., 9826 Hartman Ave., Omaha, NE (US) 68134

( * ) Notice: Subject to any disclaimer, the term of this patent is extended or adjusted under 35 U.S.C. 154(b) by 0 days.

(21) Appl. No.: 09/440,183

(22) Filed: Nov. 15, 1999

(51) Int. Cl.[7] ..... A47B 91/00
(52) U.S. Cl. ..... 248/346.02; 248/346.01
(58) Field of Search ..... 248/346.01, 346.02; 108/901, 51.11; 52/789.1; 206/386, 591, 594, 521.1; D9/341; 217/18

(56) References Cited

U.S. PATENT DOCUMENTS

| | | | | |
|---|---|---|---|---|
| D. 369,743 | * | 5/1996 | Pintar et al. | D9/341 |
| 3,003,599 | * | 10/1961 | Rubissow | 428/179 |
| 3,008,702 | * | 11/1961 | Breneman | 267/153 |
| 3,680,495 | * | 8/1972 | Pike | 108/53.3 |
| 3,695,188 | * | 10/1972 | Granatstein | 108/57.28 |
| 4,339,040 | * | 7/1982 | Peil et al. | 206/599 |
| 4,348,442 | * | 9/1982 | Figge | 428/72 |
| 5,401,347 | * | 3/1995 | Shuert | 156/245 |

* cited by examiner

*Primary Examiner*—Ramon O. Ramirez
*Assistant Examiner*—Holly N. Sy
(74) *Attorney, Agent, or Firm*—George R. Nimmer

(57) ABSTRACT

A load-bearing platform is thermoformably molded from a single sheet of thin-gauge resinous material. In pallet-like horizontal orientation, the platform includes four upright planes including 60 degree-angularly intersecting diagonal planes emanating from the perpendicular intersection of longitudinal-plane and a transverse-plane. There is a load-bearing topical-plane including therealong geometrically similar (e.g. circular or hexagonal) topical-shoulders respectively surroundably provided with depending collar-like columns, and which columns along a platform bottom-plane are aptly semi-peripherally connected with platform bottom-shoulders. Respective columns in parallelism with the diagonal-planes and with the transverse-plane are connected with thermally-fused dual-walls upright ribs, each rib being rooted at the bottom-shoulders and having an upright extremity adjacent to topical-shoulders. The thusly arrayed thermally-fused ribs provide linearly and intersectionally arrayed series of ribs-effected-stiffeners to afford unusual strength for moderately topically loaded thermoformed platforms.

2 Claims, 5 Drawing Sheets

THERMOFORMED LOAD-BEARING PLATFORM

BACKGROUND OF THE INVENTION

The designations "load-bearing platforms" and "load-bearing pallets" are interchangeably employed in the art. Traditionally known pallets, currently yet in common usage, are constructed of wooden planks. Because their wooden construction makes them very expensive and inherently plagued with splintering, rotting, weather degradation, and short lifespan, more recent prior art workers have attempted to construct pallets consisting of resinous material throughout. Such attempts when utilizing cavity-molding, injection-molding and/or rotational-casting fabrication techniques require massive (and hence non-economical) amounts of resinous construction material. Accordingly, other recent prior art workers have attempted to economically provide high load-bearing capability resinous pallets through utilization of the "single-sheet thermoforming" fabrication technique which empirically includes pluralities of load-bearing topical-shoulders and substrate-abuttable bottom-shoulders that are structurally-continuously interveningly joined with prescribed upright connections intended to prevent "buckling" of a reasonably topically loaded pallet. However, as indicated in U.S. Pat. No. 3,140,672 (Jul. 14, 1964); U.S. Pat. No. 3,424,110 (Jan. 28, 1969; and U.S. Pat. No. 3,695,188 (Oct. 3, 1972): such prior art efforts utilizing the "single-sheet thermoforming" molding technique have not succeeded in the economic provision of pallets having buckle-resistant reasonable load-bearing capability. Generally, the prior art pallets have been molded using plastic sheet material thicker than ¼". The invention of this load-bearing platform allows the use of sheet thinner than ⅛" to be used to mold a pallet that weighs less than 10 pounds, yet will support a uniform load of over 500 pounds.

GENERAL OBJECTIVES OF THE INVENTION

In view of the afore-recited Background of the Invention, it is accordingly the general objective of the present invention to provide improved resinously constructed pallet-like load-bearing platforms that are economically resinously singularly-constructed through-out according to the single-sheet thermoforming fabrication technique and wherein the resulting economically constructed platform has non-buckling capability when reasonably topically loaded and which economical and functional results have not been attainable with prior art single-sheet thermoforming fabrication techniques. An optional objective is to economically and reliably underlyingly provide forklifting capability for a such thermally thermoformed load-bearing platform.

GENERAL STATEMENT OF THE INVENTION

With the above general objectives in view, and together with other ancillary and related objectives which will become more apparent in the ensuing detailed description of the appended drawings, the structurally-continuously resinously-hermoformed load-bearing platform concept of the present invention in a pallet-like horizontal orientation includes: a horizontal load-bearing topical-plane overlying a substrate abuttable bottom-plane and uprightly axially oriented along mutually equi-angularly intersecting first and second diagonal-planes and a transverse-plane; the load-bearing topical-plane being provided with geometrically similar (e.g. hexagonal, circular) distinctly separated topical-shoulders and from each surroundably depends a collar-like column: the bottom-plane being provided therealong with a plurality of generally triangular bottom-shoulders and each being tri-peripherally connected to a minor portion of columns depending from three adjacent topical-shoulders; and, respective columns being intraventionally provided with dual-walls upright- ribs, each said rib having its root at apeces of two bottom-shoulders and upwardly therefrom terminating substantially between two adjacent topical-shoulders, and said ribs providing numerous lineal arrays of stiffener-ribs for the platform including arrays lying parallel to the first-diagonal-plane, parallel to the second-diagonal-plane, and yet another array parallel to the transverse-plane.

BRIEF DESCRIPTION OF THE DRAWINGS

In the drawing, wherein like characters refer to like parts in the several views, and in which.

DETAILED DESCRIPTION OF THE DRAWINGS

Figure 1:
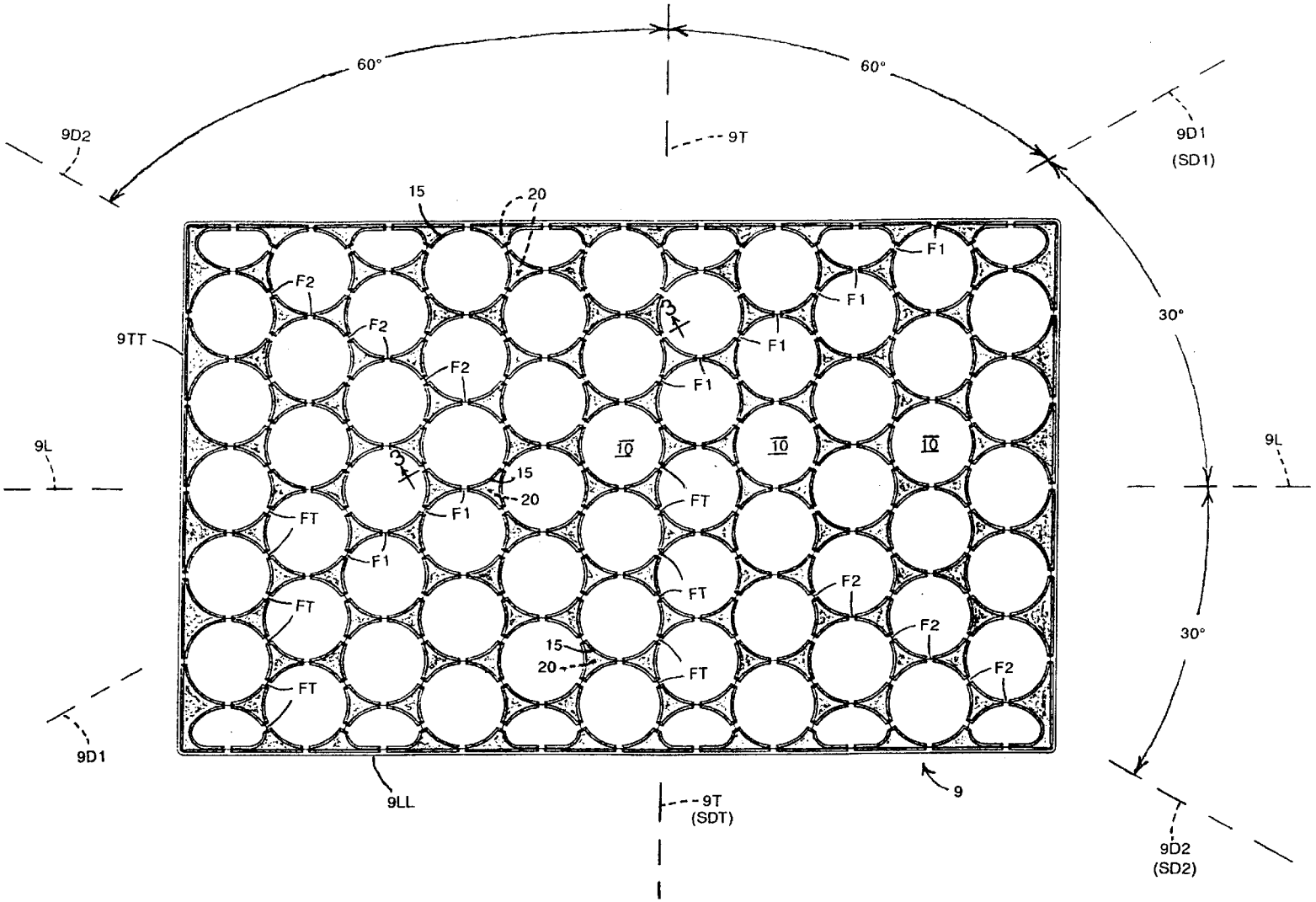
FIG. 1 is a top plan view of a representative embodiment (9) of the "thermoformed load-bearing platform" of the present invention.
Figure 1A:
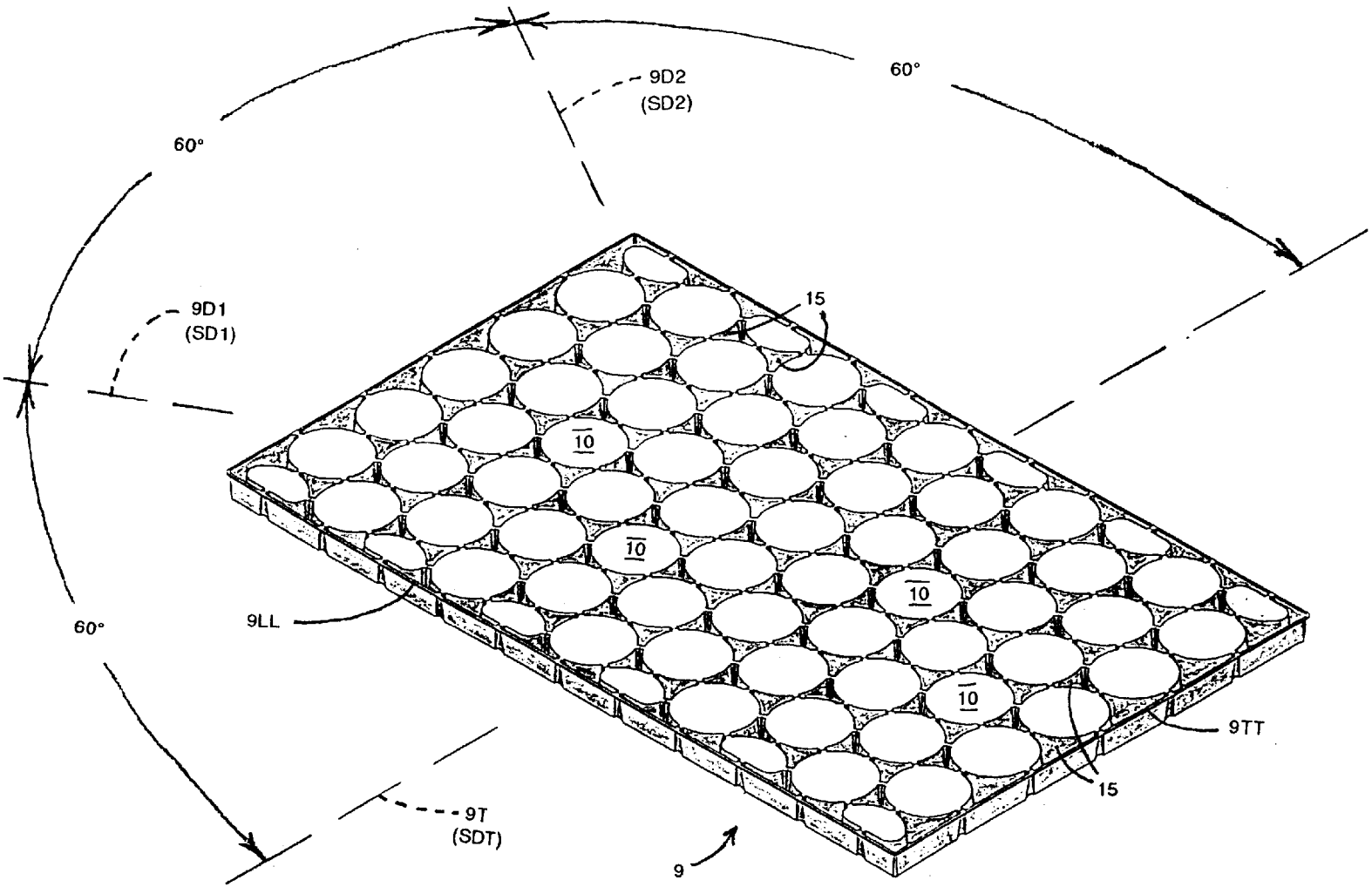
FIG. 1A is a substantial repeat of FIG. 1 but in a topical perspective mode so as to expose the uprightly longitudinally extending and transversely extending sideward edge construction.

As alluded to in the drawing, representative embodiment (9) of the "thermoformed load-bearing platform" of the present invention (which is thermoformably molded throughout from a single sheet of polyethylene or similar thermoplastic resinous material) is directionally oriented, as follows:

(I) along four upright planes including a longitudinal plane (9L) perpendicularly intersecting a transverse plane (9T), and also including an upright first-diagonal-plane (9D1) which at a 60° angle intersects an upright second-diagonal-plane (9D2), at the intersection of planes (9L) and (9T);

(II) in flanking parallelism to longitudinal plane (9L), upright longitudinal sides 9LL, and in flanking parallelism to transverse plane(9T), upright transverse sides 9TT; and (III) perpendicularly intersecting said upright planes 9L, 9T, 9D1, and 9D2: a load-bearing horizontal topical-plane TP and a substrate-abuttable horizontal bottom-plane BP.

Extending along horizontal topical-plane TP are numerous distinctly separated and geometrically similar topical-shoulders (10), each being preferably of circular or hexagonal plan shape. Topical-shoulders are arranged in staggered rows as seen in FIG. 1. Each topical-shoulder (10) is surrounded by a downwardly extending collar-like column (15) having its lower terminus along said horizontal bottom-plane(BP). Extending along such bottom-plane (BP) are numerous generally triangular bottom-shoulders (20) and, along the three sides of each, are connected to a minor portion e.g. 60°) of cell columns (15) depending from three immediately adjacent topical-shoulders (10).

Figure 3:
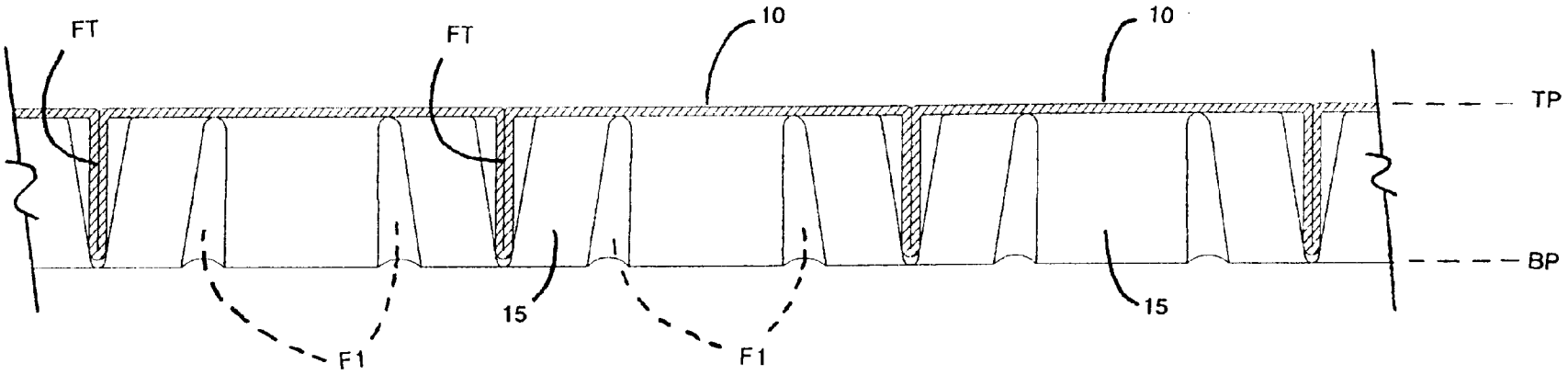
FIG. 3 is a sectional elevational view taken along line 3—3 of FIG. 1 and especially alluding to dual-walls upright ribs (F1, F2, FT) which when appropriately tri-directionally arrayed (as suggested in FIG. 1B) into a multitude of linearly extending stiffener-ribs provides remarkable strength to the "thermoformed load-bearing platform".

Respective cell columns (15), at regular angular increments therearound (e.g. 60° increments), are provided with thermally-fused dual-walls upright ribs assigned the generic designation (F) and the sub-generic designations (F1, F2, FT). As alluded to such reference characters F in drawing FIG. 3 (e.g. at FT), such thermally-fused condition is readily visually-discernible as an pright line-of-merger. Each such rib (F) has its root at a confronting apeces of two adjacent bottom-shoulders (20) and upwardly terminates substantially midway two confrontingly adjacent topical-shoulders (10). Such 60°-incremental positioning for the respective fused-walls ribs(F) is effected by virtue of the platform's thermally-energized mold being designed with 60°-incremental upright slotted gaps appropriately located at the mold's upright columnar positions The said multitude of platform upright ribs (F) are linearly arrayed, continuously uninterruptedly from peripheral-edges, in the following respective modes:

(i) many of ribs (as F1) are arrayed into lineal rows respectively parallel to first-diagonal-plane (9D1) so as to afford a parallel series of first-stiffeners (SD1);

(ii) many of ribs (as F2) are arrayed into lineal rows respectively parallel to second-diagonal-plane (9D2) so as to afford a parallel series of second-stiffeners (SD2); and (iii) many of ribs (as FT) are arrayed into lineal rows respectively parallel to the transverse-plane (9T) so as to afford a parallel series of third-stiffeners (SDT).

Figure 1B:
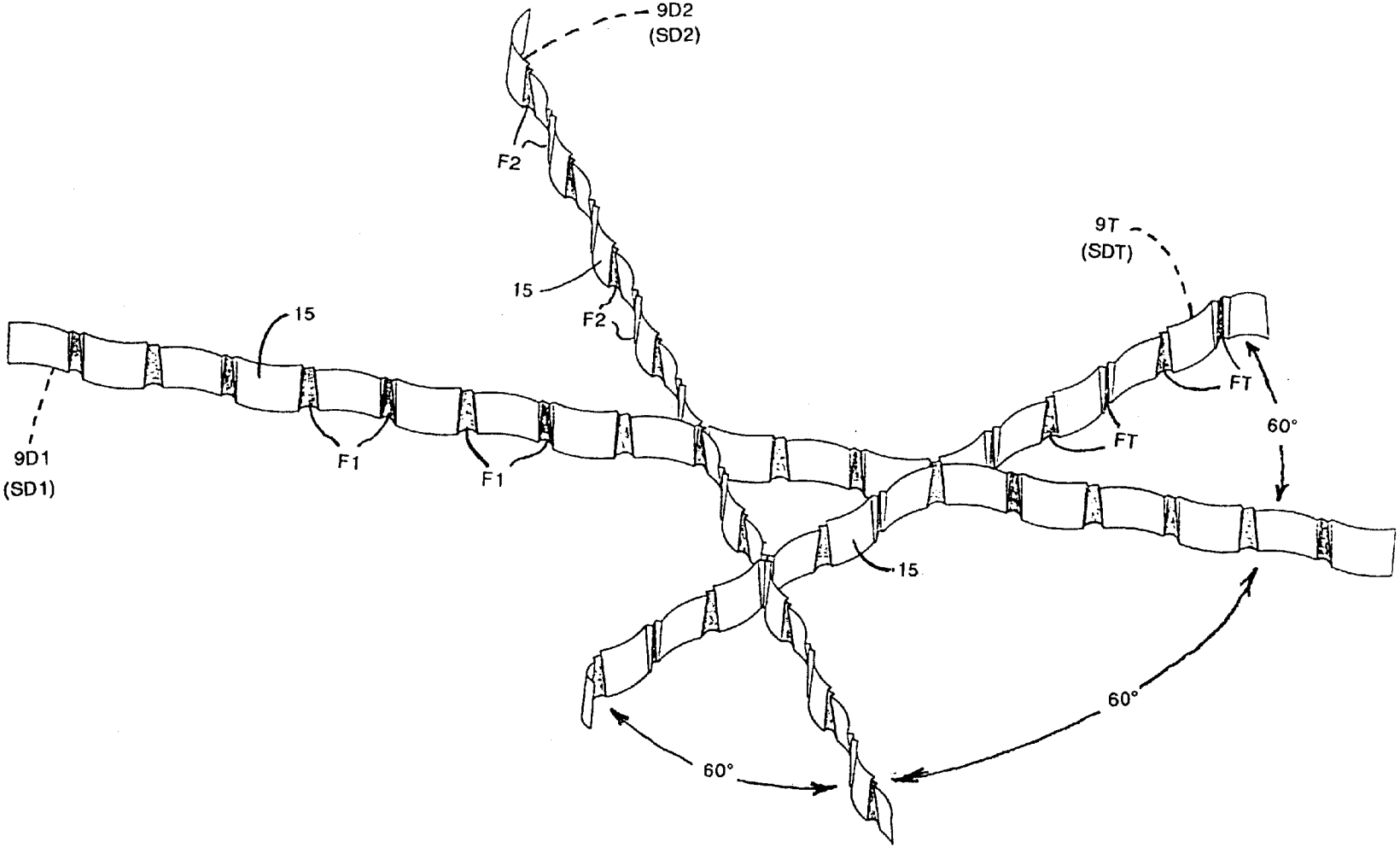
FIG. 1B is a schematic view alluding to a multitude of the dual-walls ribs (F1, F2, FT) mentioned immediately below with reference to FIG. 3, the ribs (F1, F2, FT) being linearly arrayed into equi-angularly extending stiffener-ribs for the platform.
Figure 2:
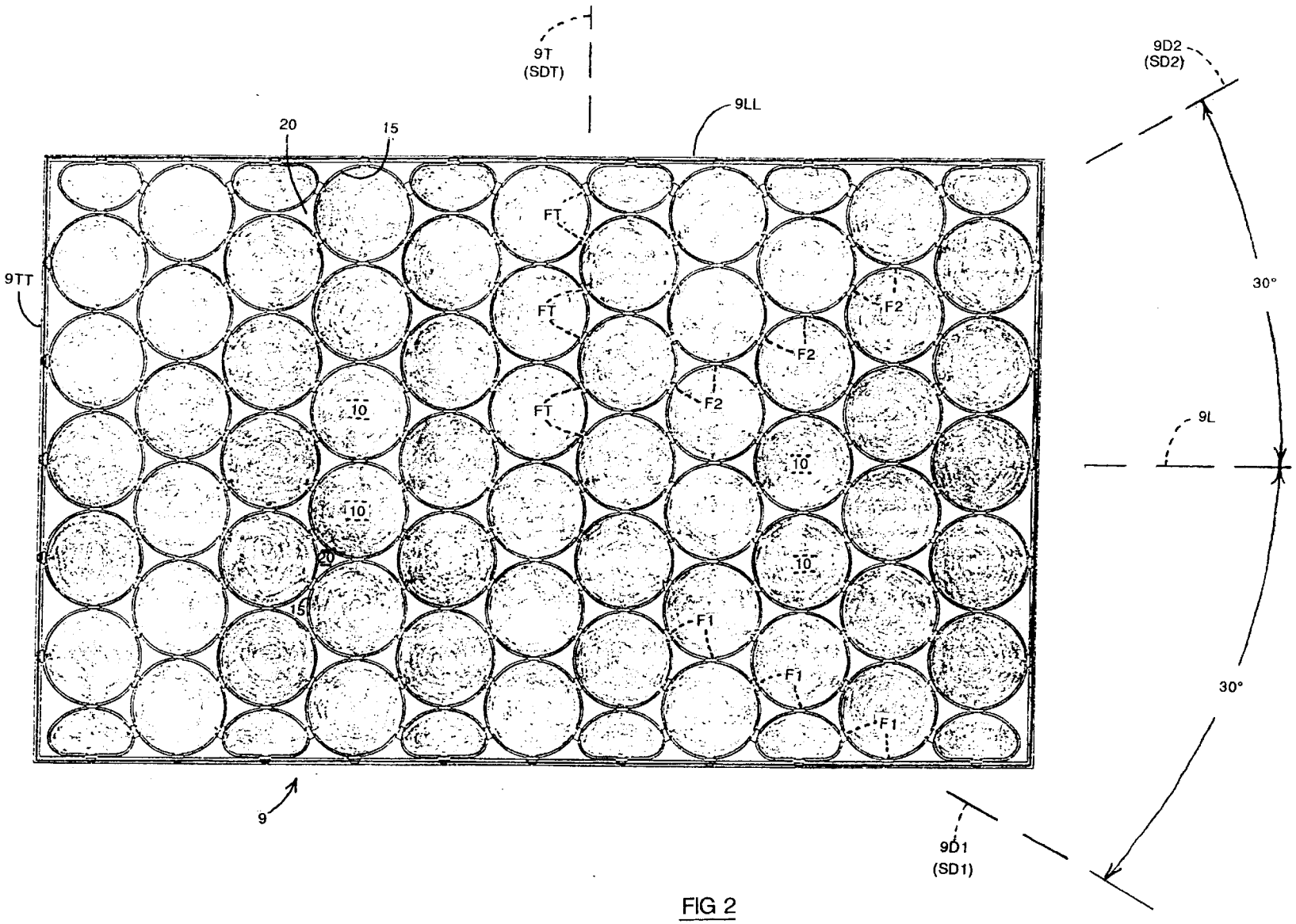
FIG. 2 is a bottom plan view of the FIGS. 1 and 1A representative embodiment (9)

Thus, in view of the immediately foregoing sub-paragraphs (i)–(iii), and as schematically alluded to in drawing FIG. 1B: the multiple tri-directional series of respectively 60°-intersecting ribs-provided first-stiffeners (SD1), second-stiffeners (SD2), and third-stiffeners (SDT) together cooperatively provide remarkable resistance to downward buckling of moderately topically loaded horizontal platforms (e.g. 9) that are thermoformably molded from relatively light-gauge resinous sheets. In the latter regard, a such platform (e.g. 9) moldably thermoformed even of 60–80 mil thin-gauge polyethylene sheeting will topically support heavy loads not envisioned by prior art workers.

Envisioned herein are "thermoformed load-bearing platforms" augmented with a plurality of co-molded "feet" depending below the bottom-plane so as to afford a "fork-lifting capability".

Though perhaps redundently, it might be ancillarily observed as follows:

> the "thermoformed load-bearing-platform" is designed to be vacuum/pressure formed out of a angle of resinous plastic sheet to minimize weight and cost, yet provide a three dimensional load bearing structure capable of supporting a workable load.; in order to thermoform the plastic structure, the mold to form the platform has to be designed in a special configuration that has six tapered sharp edged slots in order to create the fused columns to adjoining cells;

the load bearing surface is the area of the thermoformed plastic sheet that is drawn down into the mold bottom of each cell. When the formed plastic "platform" part is turned mold side up, it provides a flat load bearing platform only interrupted by the spaces that form the underlying supporting rib pattern that merges into the fused columns which give the "platform" its strength (FIG. 3); and the downward load force vector results in a compressive force on the fused ribs portions, and thus, the ribs walls fusions do not have a tendency to be walls-separated during a "platform" topically loaded condition.

From the foregoing, the construction and operation of the "thermoformed load-bearing platform" concept of the present invention will be readily understood and further explanation is believed to be unnecessary. However, since numerous modifications and changes will readily occur to those skilled in the art, it is not desired to limit the scope of the invention, except as recited in the appended claims.

I claim:

1. Thermoformed horizontal load-bearing platform having generally rectangularly defined peripheral-edges, and topically extending along an upright first-diagonal-plane and an upright second-diagonal-plane respectively emanating at opposite 30° angles from the intersection of a mutually perpendicular upright longitudinal-plane and an upright transverse-plane, said horizontal platform being wholly thermoformably constructed throughout of a single sheet of thermoplastic resinous material, and comprising:

(A) extending along a horizontal topical-plane thereof, a plurality of geometrically similar load-bearing topical-shoulders, the geometric periphery of each being provided with a downwardly extending surrounding collar-like column;

(B) extending along a horizontal bottom-plane thereof, a plurality of generally triangular bottom-shoulders and each being triperipherally connected to a minor portion of said columns that depend from three adjacent topical-shoulders; and (C) extending upwardly apexially from each said bottom-shoulder and terminating thus upwardly adjacently to a topical-shoulder, dual-walls thermally-fused upright ribs and wherein such thermally-fused condition is readily visually-thudiscernable as an upright line-of-merger and whereby accordingly extending operationally among platform peripheral-edges are:

(i) a number of said thermally-fused ribs lie in a plurality of lineal-arrays parallel to said first-diagonal-plane to provide a series of linearly arrayed parallel first-stiffeners;

(ii) a number of said thermally-fused ribs lie in a plurality of lineal-arrays parallel to said second-diagonal-plane to provide a series of linearly arrayed second-stiffeners; and (iii) a number of said theremally-fused ribs lie in a plurality of lineal-arrays parallel to said transverse-plane to provide a series of linearly arrayed third-stiffeners; and whereby the above recited tri-directional series of respectively 60°-intersecting first-stiffeners, second-stiffeners, and third-stiffeners, together provide significant resistance against downward buckling of a moderately topically loaded said thermoformed horizontal platform.

2. The thermoformed horizontal load-bearing platform structure of claim 1 wherein the bottom-plane bottom-shoulders are respectively of concavely triangular - shape and respectively attached to one-sixth peripheral portions of columns depending from three adjacently located topical-shoulders.

* * * * *